US011600226B2

(12) United States Patent
Hwang

(10) Patent No.: US 11,600,226 B2
(45) Date of Patent: Mar. 7, 2023

(54) DISPLAY DEVICE

(71) Applicant: Samsung Display Co., Ltd., Yongin-si (KR)

(72) Inventor: Jong Kwang Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/389,230

(22) Filed: Jul. 29, 2021

(65) Prior Publication Data

US 2022/0036814 A1 Feb. 3, 2022

(30) Foreign Application Priority Data

Jul. 30, 2020 (KR) ..... 10-2020-0095355

(51) Int. Cl.
*G09G 3/3233* (2016.01)
*G09G 3/3208* (2016.01)

(52) U.S. Cl.
CPC ..... *G09G 3/3233* (2013.01); *G09G 3/3208* (2013.01); *G09G 2310/08* (2013.01); *G09G 2320/0233* (2013.01); *G09G 2320/0247* (2013.01); *G09G 2320/0257* (2013.01); *G09G 2320/041* (2013.01); *G09G 2320/103* (2013.01)

(58) Field of Classification Search
CPC ..... G09G 3/3233; G09G 3/3208; G09G 2310/08; G09G 2320/0233; G09G 2320/0247; G09G 2320/0257; G09G 2320/041; G09G 2320/103
See application file for complete search history.

(56) References Cited

U.S. PATENT DOCUMENTS 8,044,899 B2 * 10/2011 Ng ..... G02F 1/1309 345/83
8,466,869 B2 * 6/2013 Kobayashi ..... H04N 13/341 345/84
8,610,697 B2 * 12/2013 Hasegawa ..... G09G 3/3258 345/208
8,675,027 B2 * 3/2014 Nakano ..... G09G 3/3413 345/63
8,817,012 B2 * 8/2014 Hasegawa ..... G09G 5/10 345/76

(Continued)

FOREIGN PATENT DOCUMENTS

CN 102768821 2/2015
KR 10-2019-0030065 3/2019

(Continued)

*Primary Examiner* — Michael J Jansen, II
(74) *Attorney, Agent, or Firm* — H.C. Park & Associates, PLC

(57) ABSTRACT

A display device includes: a pixel; a scan driver configured to supply a scan signal to the pixel through a scan line; an emission driver configured to supply an emission control signal comprising a plurality of gate-on level signals to the pixel through an emission control line in one frame, the plurality of gate-on level signals for generating emission periods of the pixel; a data driver configured to supply a data signal to the pixel through a data line; and a controller configured to control a waveform of the emission control signal, wherein a length of a first emission period of the emission periods is longer than a length of another emission period of the emission periods.

16 Claims, 12 Drawing Sheets

(56) References Cited

U.S. PATENT DOCUMENTS

| | | | | |
|---|---|---|---|---|
| 9,495,911 | B2 * | 11/2016 | Takanohashi | G09G 3/3225 |
| 9,899,000 | B2 * | 2/2018 | Takahota | G09G 5/18 |
| 9,984,623 | B2 * | 5/2018 | An | G09G 3/3233 |
| 10,424,255 | B2 * | 9/2019 | Pyo | G09G 3/3233 |
| 10,885,842 | B2 * | 1/2021 | Kang | G09G 3/3266 |
| 2003/0214521 | A1 * | 11/2003 | Osame | G09G 3/3283 345/690 |
| 2004/0070590 | A1 * | 4/2004 | Lee | G09G 3/2022 345/690 |
| 2005/0035981 | A1 * | 2/2005 | Ozaki | G09G 5/399 345/690 |
| 2005/0280614 | A1 * | 12/2005 | Goh | G09G 3/3233 345/76 |
| 2009/0001251 | A1 * | 1/2009 | Ng | G01J 3/50 250/205 |
| 2009/0201286 | A1 * | 8/2009 | Hasegawa | G09G 3/3258 345/84 |
| 2009/0207193 | A1 * | 8/2009 | Isobe | G09G 3/3266 345/77 |
| 2010/0085341 | A1 * | 4/2010 | Hasegawa | G09G 3/3233 345/208 |
| 2011/0090202 | A1 * | 4/2011 | Han | G09G 3/3233 345/76 |
| 2011/0157244 | A1 * | 6/2011 | Nakano | G09G 3/3413 345/690 |
| 2012/0081624 | A1 * | 4/2012 | Kobayashi | G09G 3/3406 349/15 |
| 2015/0154905 | A1 * | 6/2015 | Takanohashi | G09G 3/3225 345/694 |
| 2015/0235620 | A1 * | 8/2015 | Takahota | G09G 3/3696 345/99 |
| 2016/0155377 | A1 * | 6/2016 | Kishi | G09G 3/3208 345/214 |
| 2019/0012961 | A1 * | 1/2019 | Kim | G09G 3/3225 |
| 2019/0096331 | A1 * | 3/2019 | Kwon | G09G 3/2096 |
| 2019/0340977 | A1 | 11/2019 | Park et al. | |
| 2020/0027403 | A1 | 1/2020 | Chang et al. | |
| 2020/0082768 | A1 | 3/2020 | Oh et al. | |
| 2021/0375210 | A1 * | 12/2021 | Xuan | G09G 3/3258 |
| 2022/0036814 | A1 * | 2/2022 | Hwang | G09G 3/3233 |

FOREIGN PATENT DOCUMENTS

| | | |
|---|---|---|
| KR | 10-2019-0122056 | 10/2019 |
| KR | 10-2019-0128018 | 11/2019 |
| KR | 10-2020-0009493 | 1/2020 |
| KR | 10-2020-0030431 | 3/2020 |

* cited by examiner

MODE1 @ TEM1

MODE1 @ TEM2

DISPLAY DEVICE

CROSS-REFERENCE TO RELATED APPLICATION

This application claims priority to Korean Patent Application No. 10-2020-0095355, filed on Jul. 30, 2020, which is hereby incorporated by reference for all purposes as if fully set forth herein.

BACKGROUND

Field

Example implements of the invention relate generally to a display device and, more particularly, to a display device operating with a plurality of emission periods in one frame.

Discussion of the Background

A display device displays an image using pixels that emit various color lights (for example, red, green, and blue light), respectively. The display device may control a display luminance through an impulse dimming operation by adjusting a supply period (e.g., frequency or number) of an emission control signal.

However, during the impulse dimming operation in which one frame includes a plurality of emission periods, when an emission time in which a current flows to each of light emitting elements is shortened after writing data to a pixel, color slippage and color smudging may be visually recognized due to an difference in efficiency between the light emitting elements that respectively emit red, green, and blue light.

The above information disclosed in this Background section is only for understanding of the background of the inventive concepts, and, therefore, it may contain information that does not constitute prior art.

SUMMARY

Applicant discovered that when display devices display a moving image or a still image, image flicker and color slippage or color smudging are visually recognized by a user.

Display devices operating with a plurality of emission periods in one frame constructed according to the principles and implementations of the invention provide improved image quality. For example, when the display devices are operated with the plurality of emission periods, image flicker and color slippage or color smudging of both the moving image and the still image may be minimized or prevented such that the image quality may be improved.

According to an aspect of the invention, a display device includes: a pixel; a scan driver configured to supply a scan signal to the pixel through a scan line; an emission driver configured to supply an emission control signal comprising a plurality of gate-on level signals to the pixel through an emission control line in one frame, the plurality of gate-on level signals for generating emission periods of the pixel; a data driver configured to supply a data signal to the pixel through a data line; and a controller configured to control a waveform of the emission control signal, wherein a length of a first emission period of the emission periods is longer than a length of another emission period of the emission periods.

Non-emission periods of the pixel may be generated by a plurality of gate-off level signals of the emission control signal, and lengths of the non-emission periods may be the same in the one frame.

Lengths of the emission periods may correspond to widths of the plurality of gate-on level signals of the emission control signal, respectively.

Lengths of remaining emission periods of the emission periods except for the first emission period may be the same.

A length of a second emission period of the emission periods in the one frame may be longer than a length of a third emission period of the emission periods.

The controller is configured to analyze a change in image data to select one of a moving image mode and a still image mode and configured to adjust lengths of the emission periods according to a moving image frame of the moving image mode or a still image frame of the still image mode.

The length of the first emission period of the moving image frame may be longer than the length of the first emission period of the still image frame, and a length of a second emission period of the moving image frame may be shorter than the length of the second emission period of the still image frame.

In the moving image mode, the controller may be configured to control the lengths of the emission periods of the moving image frame based on a display luminance.

The length of the first emission period corresponding to a first display luminance may be longer than the length of the first emission period corresponding to a second display luminance greater than the first display luminance.

In the moving image mode, the controller may be configured to control the lengths of the emission periods of the moving image frame based on an ambient temperature of the display device.

In a same display luminance condition, the length of the first emission period corresponding to a first temperature may be longer than the length of the first emission period corresponding to a second temperature greater than the first temperature.

According to another aspect of the invention, a display device includes: a pixel; a scan driver configured to supply a scan signal to the pixel through a scan line; an emission driver configured to supply an emission control signal including a plurality of gate-on level signals to the pixel through an emission control line, the plurality of gate-on level signals for generating emission cycles of the pixel; a data driver configured to supply a data signal to the pixel through a data line; and a controller configured to control a number of the emission cycles during one frame based on an image data change and a display luminance.

The controller may be configured to gradually increase the number of the emission cycles to a target number of the emission cycles as a plurality of frames elapse.

The number of the emission cycles of a second frame of the plurality of frames may be greater than the number of the emission cycles of a first frame of the plurality of frames.

The number of the emission cycles of a first frame corresponding to a first display luminance may be less than the number of the emission cycles of the first frame corresponding to a second display luminance greater than the first display luminance, and the number of the emission cycles of a k-th frame corresponding to the first display luminance may be the same as the number of the emission cycles of the k-th frame corresponding to the second display luminance, where k is an integer greater than 3.

The controller may be configured to analyze the image data change to select one of a still image mode and a moving image mode, when the still image mode may be started, the controller may be configured to gradually increase the number of the emission cycles to a target number of the emission cycles as a plurality of frames elapse, and the number of the emission cycles of the k-th frame of the still image mode may be greater than the number of the emission cycles of the k-th frame of the moving image mode.

The controller may be configured to further control a change in the emission cycles based on an ambient temperature of the display device, and in a same display luminance condition, a number of a plurality of frames required for increasing the number of the emission cycles to a target number of the emission cycles in correspondence with a first temperature may be greater than the number of the plurality of frames required for increasing the number of the emission cycles to the target number of the emission cycles in correspondence with a second temperature greater than the first temperature.

According to another aspect of the invention, a display device includes: a pixel; a scan driver configured to supply a scan signal to the pixel through a scan line; an emission driver configured to supply an emission control signal including a plurality of gate-on level signals to the pixel through an emission control line, the plurality of gate-on level signals for generating emission periods and emission cycles of the pixel; a data driver configured to supply a data signal to the pixel through a data line; and a controller configured to control lengths of the emission periods and a number of the emission cycles during one frame, based on a change of image data and a display luminance.

In a moving image frame of a moving image mode, a length of a first emission period of the emission periods may be longer than a length of another emission period of the emission periods, and wherein, in the moving image mode, the length of the first emission period corresponding to a first display luminance may be longer than the length of the first emission period corresponding to a second display luminance greater than the first display luminance.

The number of the emission cycles may gradually increase to become a target number of the emission cycles as a plurality of frames elapse in a still image mode, in the still image mode, the number of the emission cycles of a first frame of the plurality of frames corresponding to a first display luminance may be less than the number of the emission cycles of the first frame corresponding to a second display luminance greater than the first display luminance, and a number of the emission cycles of a k-th frame corresponding to the first display luminance may be the same as the number of the emission cycles of the k-th frame corresponding to the second display luminance, where k is an integer greater than 3.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the inventive concepts.

DETAILED DESCRIPTION

Figure 1:
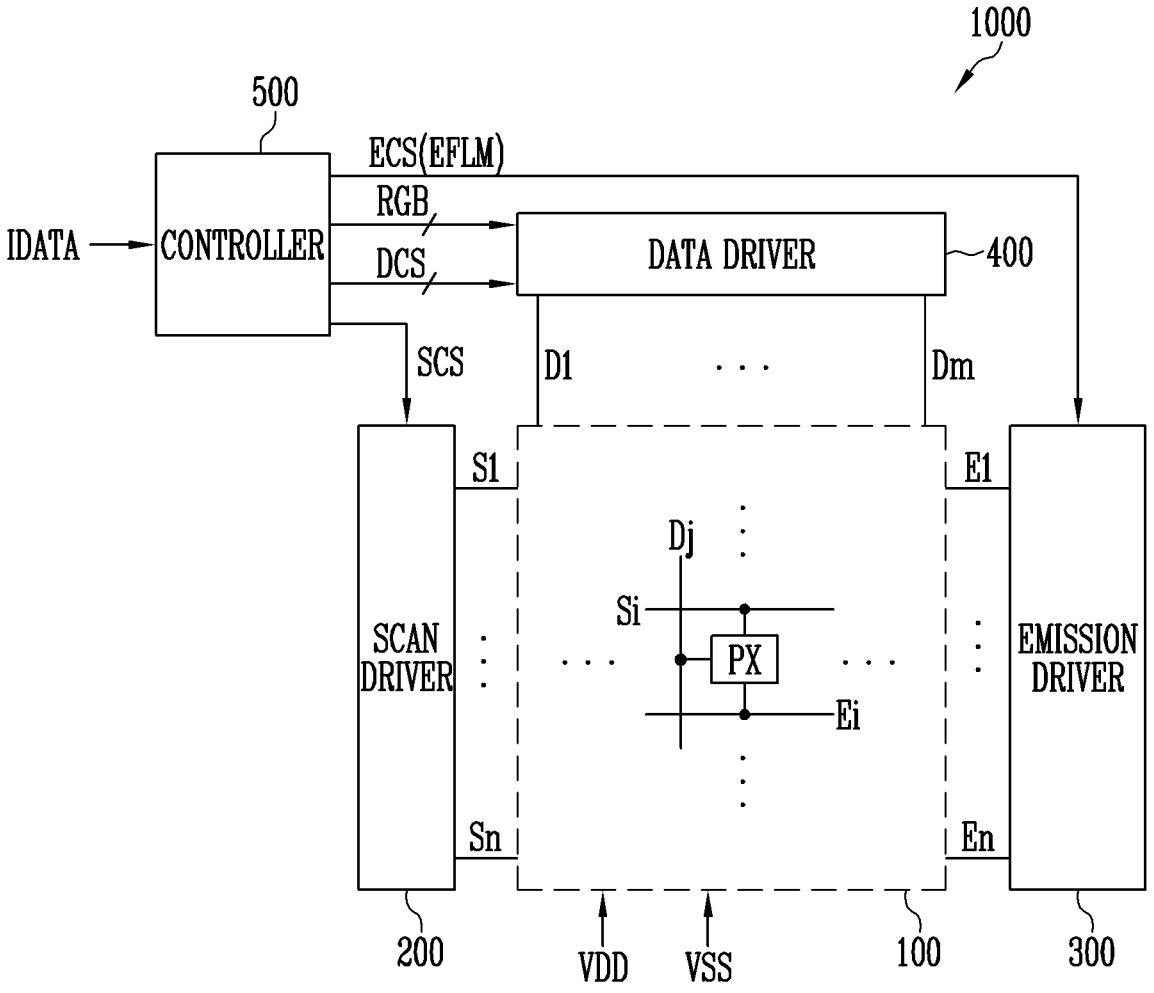
FIG. 1 is a block diagram of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, example embodiments will be described in detail with reference to the accompanying drawings. The same reference numerals are used for the same components in the drawings, and repetitive description of the same components is omitted.

FIG. 1 is a block diagram of an embodiment of a display device constructed according to the principles of the invention.

Referring to FIG. 1, the display device 1000 may include a pixel unit 100, a scan driver 200, an emission driver 300, a data driver 400, and a controller 500.

The pixel unit 100 displays an image. The pixel unit 100 includes pixels PX positioned to be connected to data lines D1 to Dm, scan lines S1 to Sn, and emission control lines E1 to En. The pixels PX may receive voltages of a first driving power VDD, a second driving power VSS, and an initialization power from the outside.

Additionally, the pixels PX may be connected to one or more scan lines Si and emission control lines Ei in correspondence with a pixel circuit structure. The pixel PX may include a driving transistor, a plurality of switching transistors implemented by at least one of an n-type transistor and a p-type transistor, and a light emitting element.

The controller 500 may receive an input control signal and an input image data IDATA from an image source such as an external graphic device. The controller 500 may include a timing controller that generates image data RGB suitable for an operation condition of the pixel unit 100 based on the input image data IDATA and provides the image data RGB to the data driver 400.

In an embodiment, the timing controller may generate a first control signal SCS for controlling a driving timing of the scan driver 200, a second control signal ECS for controlling a driving timing of the emission driver 300, and a third control signal DCS for controlling a driving timing of the data driver 400, based on the input control signal, and may provide the first control signal SCS, the second control signal ECS, and the third control signal DCS to the scan driver 200, the emission driver 300, and the data driver 400, respectively.

In an embodiment, the controller 500 may control a supply timing of a start signal EFLM included in the second control signal ECS based on a dimming signal for determining a display luminance of the pixel unit 100. Here, dimming refers to a technique for limiting the maximum luminance of the pixel unit 100 (e.g., a luminance of the maximum grayscale of the pixel unit 100). For example, the dimming may refer to displaying an image by selecting one of a plurality of preset dimming levels, and the luminance of the maximum grayscale may be changed to 350 nit, 250 nit, 200 nit, or the like in correspondence with the dimming level. For example, as the dimming level is increased, the maximum luminance of the pixel unit 100 is increased.

In an embodiment, the controller 500 may determine whether the image is a moving image or a still image based on the input image data IDATA, and determine the driving operation of the display device 1000 as a driving operation of a moving image mode or a driving operation of a still image mode.

In addition, the controller 500 may control the supply timing of the start signal EFLM based on an ambient temperature of the display device 1000.

The scan driver 200 may receive the first control signal SCS from the controller 500. The scan driver 200 may supply a scan signal to the scan lines S1 to Sn in response to the first control signal SCS. The first control signal SCS may include a scan start signal and a plurality of clock signals for the scan signal.

The scan signal may be set to a gate-on level (for example, a low voltage) corresponding to a type of a transistor to which a corresponding scan signal is supplied. The transistor receiving the scan signal may be set to a turn-on state when the scan signal is supplied. For example, the gate-on level (e.g., gate-on voltage) of the scan signal supplied to a P-channel metal oxide semiconductor (PMOS) transistor may be a logical low level, and the gate-on level (e.g., gate-on voltage) of the scan signal supplied to an N-channel metal oxide semiconductor (NMOS) transistor may be a logical high level. Hereinafter, a meaning of the expression that "the scan signal is supplied" may be understood as the expression that "the scan signal is supplied at a logical level for turning on a transistor controlled by the scan signal".

The emission driver 300 may receive the second control signal ECS from the controller 500. The emission driver 300 may supply an emission control signal to the emission control lines E1 to En in response to the second control signal ECS. The second control signal ECS may include the start signal EFLM and a plurality of clock signals for the emission control signal.

The emission control signal may be set to a gate-off level (for example, a high voltage). A transistor receiving the emission control signal may be turned off when the emission control signal is supplied, and may be set to a turn-on state in other cases. Hereinafter, a meaning of the expression that "the emission control signal is supplied" may be understood as the expression that "the emission control signal is supplied at a logical level for turning off a transistor controlled by the emission control signal".

Hereinafter, a period in which the emission control signal is supplied (e.g., a period in which an emission control signal of a gate-off level is supplied) may be understood as a non-emission period of a corresponding pixel, and a period in which the emission control signal is not supplied (e.g., a period in which an emission control signal of a gate-on level is supplied) may be understood as an emission period of a corresponding pixel.

The data driver 400 may receive the third control signal DCS from the controller 500. The data driver 400 may convert the image data RGB into an analog data signal (e.g., a data voltage) in response to the third control signal DCS and supply the data signal to the data lines D1 to Dm.

Referring to FIG. 1, for convenience of description, each of the scan driver 200 and the emission driver 300 is a single configuration, but embodiments are not limited thereto. For example, the scan driver 200 may include a plurality of scan drivers respectively supplying at least one of scan signals of different waveforms. In addition, at least a portion of the scan driver 200 and the emission driver 300 may be integrated into one driving circuit, module, or the like.

In an embodiment, the display device 1000 may further include a power supply. The power supply may supply the voltage of the first driving power VDD and the voltage of the second driving power VSS for driving the pixel PX to the pixel unit 100.

Figure 2:
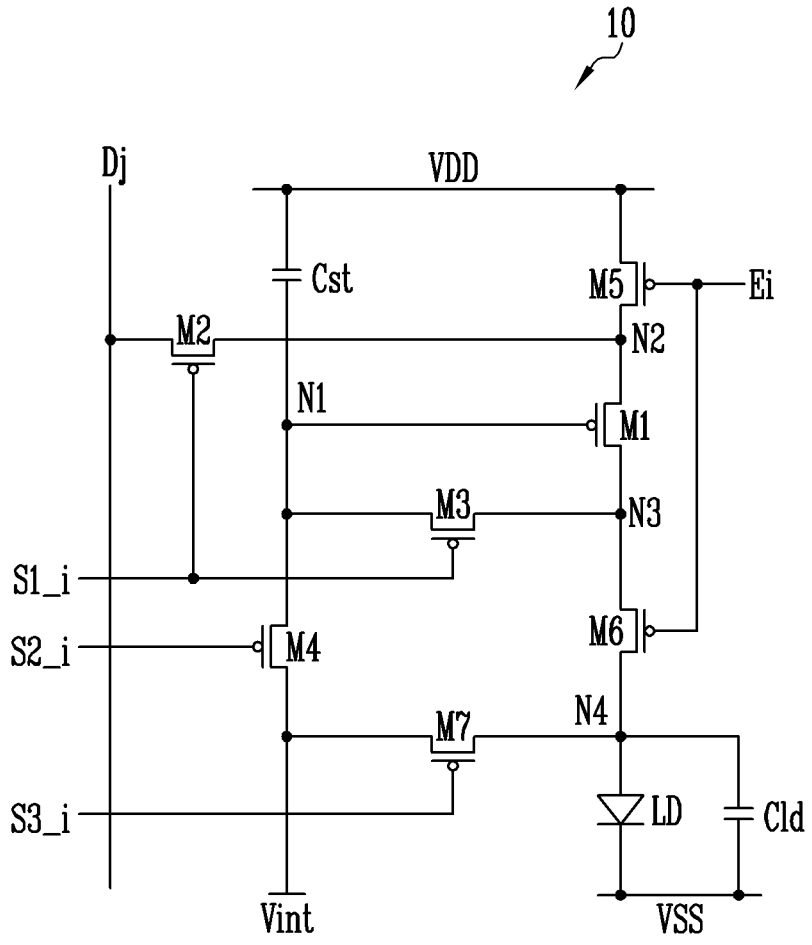
FIG. 2 is a circuit diagram of an example of a representative pixel of the display device of FIG. 1.

FIG. 2 is a circuit diagram of an example of the pixel of the display device of FIG. 1.

In FIG. 2, for convenience of description, a pixel 10 positioned on an i-th horizontal line (e.g., an i-th pixel row) and connected to a j-th data line Dj is shown (where i and j are natural numbers).

Referring to FIG. 2, the pixel 10 may include a light emitting element LD, first to seventh transistors M1 to M7, and a storage capacitor Cst. In addition, a capacitor Cld connected with the light emitting element LD in parallel may be further included.

A first electrode of the light emitting element LD may be connected to one electrode (e.g., a fourth node) of the sixth transistor M6, and a second electrode may be connected to the second driving power VSS. The light emitting element LD may generate light of a predetermined luminance in correspondence with a current amount (e.g., a driving current) supplied from the first transistor M1.

In an embodiment, the light emitting element LD may be an organic light emitting diode including an organic light emitting layer. In another embodiment, the light emitting element LD may be an inorganic light emitting element formed of an inorganic material. In another embodiment, the light emitting element LD may be a light emitting element configured of a combination of an inorganic material and an organic material. Alternatively, the light emitting element LD may have a form in which a plurality of inorganic light emitting elements are connected in parallel and/or in series between the second driving power VSS and the fourth node N4.

The capacitor Cld may be connected between the fourth node N4 and the second driving power VSS. The capacitor Cld may be a parasitic capacitor and may store a voltage difference between both ends of the light emitting element LD when the light emitting element LD emits light.

The first transistor M1 may be connected between a second node N2 and a third node N3. The first transistor M1 may generate the driving current and provide the driving current to the light emitting element LD. A gate electrode of the first transistor M1 may be connected to the first node N1. The first transistor T1 may control the current amount (e.g., the driving current) flowing from the first driving power VDD to the second driving power VSS via the light emitting element LD based on a voltage of the first node N1. To this end, the first driving power VDD may be set to a voltage higher than that of the second driving power VSS.

The second transistor M2 may be connected between the j-th data line Dj (hereinafter, referred to as a data line) and the second node N2. A gate electrode of the second transistor M2 may be connected to an i-th first scan line S1_*i* (hereinafter, referred to as a first scan line). The second transistor M2 may be turned on when a first scan signal is supplied to the first scan line S1_*i* to electrically connect the data line Dj and the second node N2.

The third transistor M3 may be connected between the first node N1 and the third node N3. A gate electrode of the third transistor M3 may be connected to the first scan line S1_*i*. The second transistor M2 and the third transistor M3 may be simultaneously turned on.

The fourth transistor M4 may be connected between the first node N1 and the initialization power Vint. A gate electrode of the fourth transistor M4 may be connected to an i-th second scan line S2_*i* (hereinafter, referred to as a second scan line). The fourth transistor M4 may be turned on by a second scan signal supplied to the second scan line S2_*i*. When the fourth transistor M4 is turned on, the voltage of the initialization power Vint may be supplied to the first node N1 (e.g., the gate electrode of the first transistor M1).

The fifth transistor M5 may be connected between the first driving power VDD and the second node N2. A gate electrode of the fifth transistor M5 may be connected to an i-th emission control line Ei (hereinafter, referred to as an emission control line). The sixth transistor M6 may be connected between the third node N3 and the light emitting element LD. A gate electrode of the sixth transistor M6 may be connected to the emission control line Ei. The fifth and sixth transistors M5 and M6 may be turned off when the emission control signal is supplied to the emission control line Ei, and may be turned on in other cases.

According to an embodiment, when the fifth and sixth transistors M5 and M6 are turned on, the current flowing through the first transistor M1 may be transferred to the light emitting element LD, and the light emitting element LD may emit light. The emission period of the light emitting element LD may be determined in correspondence with a turn-on period of the fifth and sixth transistors M5 and M6. In addition, the turn-on period of the fifth and sixth transistors M5 and M6 may corresponds to an on duty (e.g., the emission period) of the emission control signal, and a turn-off period of the fifth and sixth transistors M5 and M6 may correspond to an off-duty (e.g., the non-emission period) of the emission control signal.

The seventh transistor M7 may be connected to a first electrode (e.g., the fourth node N4) of the light emitting element LD. A gate electrode of the seventh transistor M7 may be connected to an i-th third scan line S3_*i* (hereinafter, referred to as a third scan line). The seventh transistor M7 may be turned on by a third scan signal supplied to the third scan line S3_*i* to supply the voltage of the initialization power Vint to the first electrode of the light emitting element LD.

The storage capacitor Cst may be connected between the first driving power VDD and the first node N1.

In an embodiment, the first scan signal and the second scan signal may be supplied at different timings. For example, the first scan signal may be supplied after the second scan signal is supplied. The third scan signal may be supplied after the first scan signal is supplied. A relationship between the first scan signal, the second scan signal, and the third scan signal may be expressed as shown in FIG. 3A.

However, this is exemplary, and the third scan signal may be supplied simultaneously with the second scan signal. In this case, the third scan line S3_*i* and the second scan line S2_*i* may be connected to each other.

Alternatively, the third scan signal may be supplied simultaneously with the first scan signal. In this case, the third scan line S3_*i* may be connected to the first scan line S1_*i*.

Figure 3A:
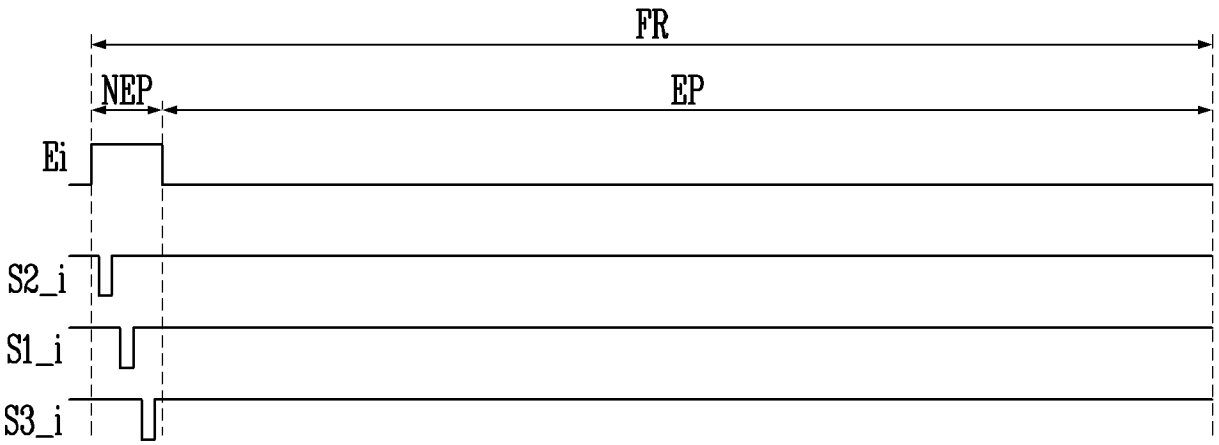
FIG. 3A and FIG. 3B are timing diagrams illustrating examples of signals supplied to the pixel of FIG. 2.
Figure 3B:
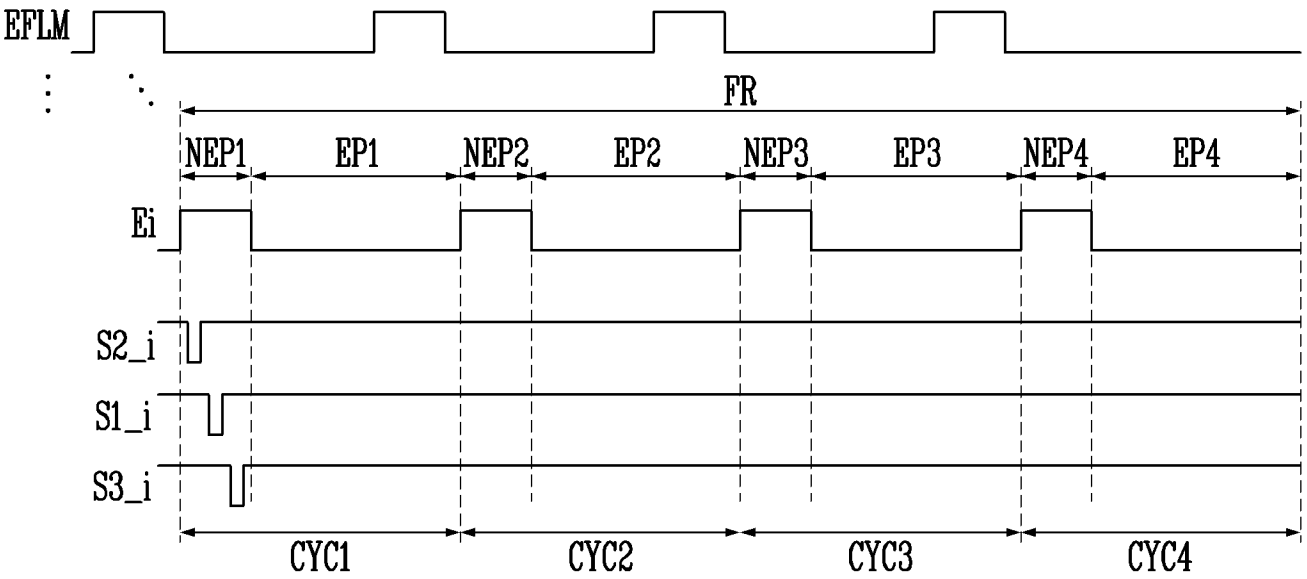

FIGS. 3A and 3B are timing diagrams illustrating examples of signals supplied to the pixel of FIG. 2.

Referring to FIGS. 2, 3A, and 3B, an emission control signal corresponding to one frame FR may define at least one emission period EP and at least one non-emission period NEP.

In an embodiment, as shown in FIG. 3A, the emission control signal supplied to the emission control line Ei may define one non-emission period NEP corresponding to a gate-off level (e.g., high level) and one emission period EP corresponding to a gate-on level (e.g., low level). The non-emission period NEP may correspond to the off duty of the emission control signal.

The non-emission period NEP may correspond to a preset horizontal period. For example, the off duty of the emission control signal may be set to about 4 horizontal periods. Here, one horizontal period may be a period in which the scan signal is shifted or a period in which the data signal is applied in a pixel column direction.

A second scan signal, a first scan signal, and a third scan signal may be sequentially supplied to the second scan line S2_*i*, the first scan line S1_*i*, and the third scan line S3_*i* in the non-emission period NEP, respectively.

When the fourth transistor M4 is turned on in response to the second scan signal, the voltage of the initialization power Vint may be supplied to the first node N1.

When the second transistor M2 and the third transistor M3 are turned on in response to the first scan signal, the data signal may be supplied to the second node N2, the first transistor M1 may be diode-connected, and a data signal in which a threshold voltage of the first transistor is compensated may be supplied to the first node N1.

When the seventh transistor M7 is turned on in response to the third scan signal, the voltage of the initialization power Vint may be supplied to the fourth node N4. At this time, a voltage of one terminal (e.g., the fourth node N4) of the capacitor Cld may be initialized to the voltage of the initialization power Vint. Therefore, the light emitting element LD may be prevented from emitting light due to a leakage current supplied from the first transistor M1 when a black luminance is implemented or displayed.

For example, the driving current and/or leakage current flowing from the first transistor M1 to the light emitting element LD may precharge the capacitor Cld, and the light emitting element LD may be set to a non-emission state during a period in which the capacitor Cld is charged.

Thereafter, when supply of the emission control signal is stopped, the emission period EP may start. For example, the fifth transistor M5 and the sixth transistor M6 may be turned on by the low level of the emission control signal supplied to the emission control line Ei, and the light emitting element LD may emit light based on the driving current flowing from the first transistor M1.

When a frame driving operation as shown in FIG. 3A for still image display is repeated, the non-emission period NEP may be repeated with a relatively long period, and thus image flicker (e.g., image flickering phenomenon) may be visually recognized. In order to prevent or minimize the image flicker, the emission control signal may be supplied so that one frame FR includes a plurality of emission cycles CYC1, CYC2, CYC3, and CYC4 as shown in FIG. 3B.

For example, in a case of high luminance emission in which the image flicker is not well recognized, the driving operation as shown in FIG. 3A (for example, referred to as 1-cycle driving operation) may be applied. However, in a display luminance range of about 200 nit or less, in order to prevent or minimize the visual recognition of the image flicker, the one frame FR may include the plurality of emission cycles.

In an embodiment, as shown in FIG. 3B, the emission control signal in the one frame FR may define a plurality of non-emission periods NEP1, NEP2, NEP3, and NEP4 corresponding to a high level and a plurality of emission periods EP1, EP2, EP3, and EP4 corresponding to a low level. For example, continuous one non-emission period NEP1 and one emission period EP1 may be one emission cycle.

A waveform of the emission control signal supplied to the emission control line Ei may be similar to the start signal EFLM supplied from the controller 500.

In an embodiment, an initialization operation of a gate voltage of the first transistor M1, data writing operation, and an initialization operation of the voltage of the fourth node N4 may be performed in the first non-emission period NEP1, and the corresponding operations may not be performed in the second to fourth non-emission periods NEP2, NEP3, and NEP4.

In one frame, lengths of the emission cycles CYC1, CYC2, CYC3, and CYC4 may be substantially the same. In other words, length of the first to fourth non-emission periods NEP1 to NEP4 may be substantially the same, and lengths of the first to fourth emission periods EP1 to EP4 may be substantially the same.

As described above, the first to fourth non-emission periods NEP1 to NEP4 are repeated in the one frame FR. Therefore, a luminance difference between a plurality of frames FR may be reduced, thereby reducing or minimizing the visual recognition of the image flicker (e.g., the image flickering phenomenon).

In FIG. 3B, the emission control signal has four emission cycles CYC1, CYC2, CYC3, and CYC4, but embodiments are not limited to a waveform of the emission control signal. For example, according to design and/or a condition, the emission control signal may include two emission cycles or eight emission cycles.

However, the length of the first emission period EP1 after the first non-emission period NEP1, in which the voltage of the fourth node N4 is initialized and the data signal is written, is relatively shorter than the length of the emission period EP of FIG. 3A. Thus, problems such as color smudging and color slippage may occur. This is described in detail with reference to FIG. 4.

Figure 4:
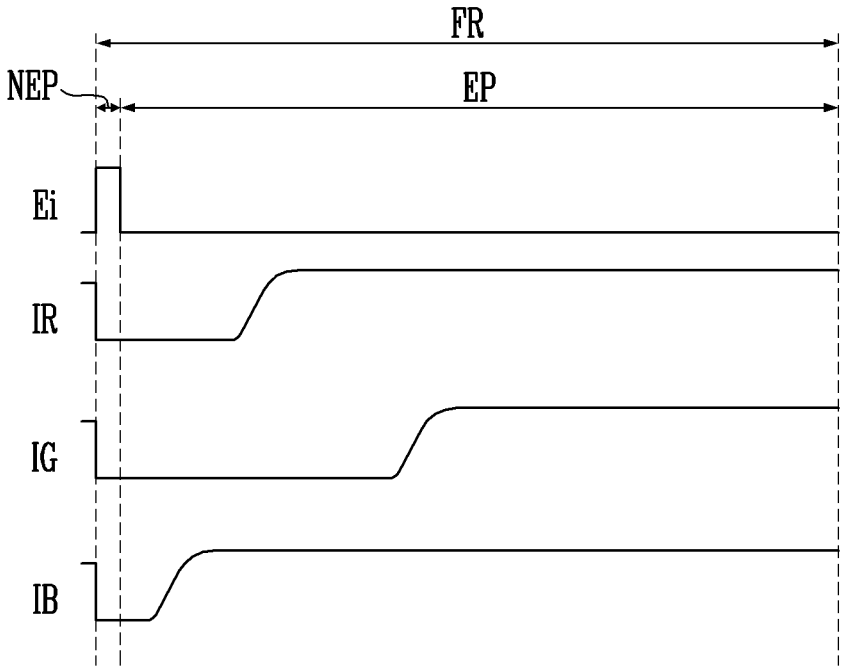
FIG. 4 is a timing diagram illustrating a change in a current flowing to light emitting elements of the pixel of the display device of FIG. 1.

FIG. 4 is a timing diagram illustrating a change in a current flowing to the light emitting elements of the pixels of the display device of FIG. 1.

Referring to FIGS. 2, 3, and 4, the pixel 10 may include a red pixel for emitting a red light, a green pixel for emitting a green light, and a blue pixel for emitting a blue light according to the light emitting element LD.

FIG. 4 shows a first current IR flowing through a light emitting element LD (hereinafter, referred to as a red light emitting element) of the red pixel, a second current IG flowing through a light emitting element LD (hereinafter, referred to as a green light emitting element) of the green pixel, and a third current IB flowing through a light emitting element LD (hereinafter, referred to as a blue light emitting element) of the blue pixel.

As described above, after the voltage of the fourth node N4 is initialized in the non-emission period NEP, when the fifth transistor M5 and the sixth transistor M6 are turned on, the capacitor Cld may be charged until the light emitting element LD emits light.

Due to an efficiency difference according to an intrinsic characteristic of the red light emitting element, the green light emitting element, and the blue light emitting element, a difference may occur in a charge time of each of the initialized capacitors Cld. Accordingly, as shown in FIG. 4, times or durations until the first current IR, the second current IG, and the third current IB reach a predetermined value for emission, may be different from each other.

When the frame FR includes the plurality of emission cycles CYC1, CYC2, CYC3, and CYC4 of FIG. 3B, the length of the first emission period EP1 is shorter than that of the emission period EP of FIG. 3A. When the length of the first emission period EP1 is shortened, a time for completely charging the capacitor Cld may be insufficient. For example, the green light emitting element having a relatively slow response speed may not or does not emit light with a luminance corresponding to the data signal in the first emission period EP1.

In particular, when a grayscale and/or a luminance between frames largely changes, due to the insufficient time for charging the capacitor Cld, a corresponding pixel may not emit light with a luminance of a provided data signal provided, and an image defect such as color slippage and color smudging may be visually recognized.

As described above, there is a trade-off relationship between the image flicker and the color slippage (or color smudging). For example, it is more advantageous in terms of the image flicker as the emission cycles are repeated in one frame FR, but it is advantageous in terms of color slippage (or color smudging) as the emission cycle decreases.

The display device according to embodiments may control the emission control signal according to a predetermined condition in order to improve image quality during impulse dimming driving operation including a plurality of emission cycles.

Figure 5:
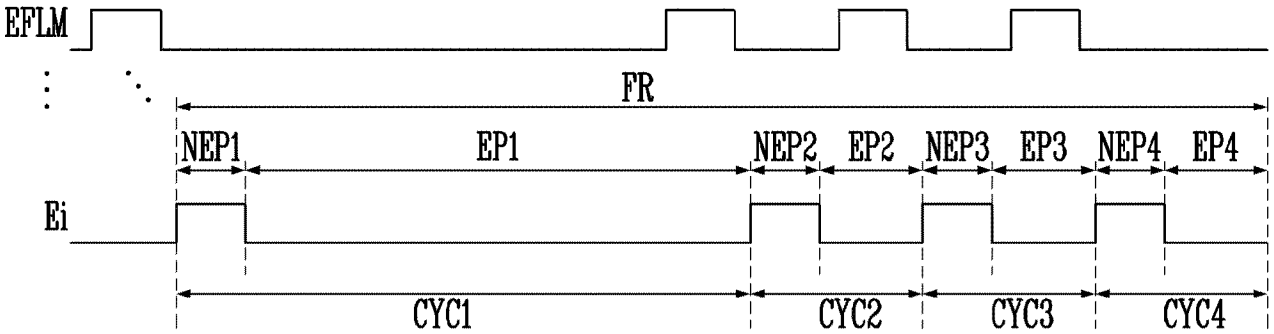
FIG. 5 is a timing diagram illustrating an example of a method of driving the display device of FIG. 1.
Figure 6:
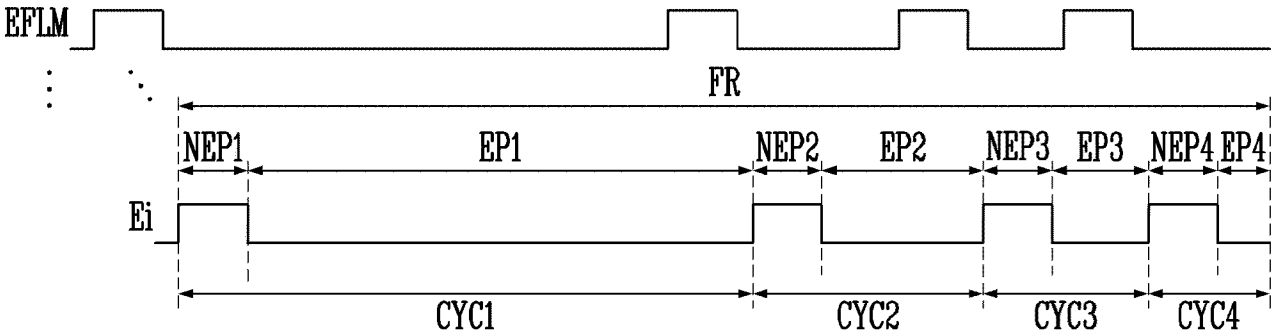
FIG. 6 is a timing diagram illustrating another example of a method of driving the display device of FIG. 1.

FIG. 5 is a timing diagram illustrating an example of a method of driving the display device of FIG. 1, and FIG. 6 is a timing diagram illustrating another example of a method of driving the display device of FIG. 1.

Referring to FIGS. 1, 2, 5, and 6, the controller 500 may control the first emission period EP1 to be longer than the other emission periods EP2, EP3, and EP4.

The controller 500 may output the start signal EFLM, and the emission driver 300 may shift and output the emission control signal in a horizontal line unit based on the start signal EFLM.

The lengths of the non-emission periods NEP1, NEP2, NEP3, and NEP4 in which the emission control signal supplied to the emission control line Ei has the gate-off level may be substantially the same.

In an embodiment, as shown in FIG. 5, the lengths of the second, third, and fourth emission periods EP2, EP3, and EP4, which are the other emission periods except for the first emission period EP1, may be substantially the same. Therefore, all of lengths of the second emission cycle CYC2, the third emission cycle CYC3, and the fourth emission cycle CYC4 may be substantially the same. Comparing FIG. 3B with FIG. 5, the length of the first emission period EP1 may increase, and the length of the second, third, and fourth emission periods EP2, EP3, and EP4 may decrease.

For example, the first emission period EP1 may occupy about 70% of a total emission time of the frame FR, and each of the second emission period EP2, the third emission period EP3, and the fourth emission period EP4 may occupy about 10% of the total emission time of the frame FR.

In an embodiment, as shown in FIG. 6, lengths of the second emission period EP2, the third emission period EP3, and the fourth emission period EP4 may be different from each other. For example, the length of the second emission period EP2 may be longer than that of the third emission period EP3, and the length of the third emission period EP3 may be longer than that of the fourth emission period EP4. A ratio of the second, third, and fourth emission periods EP2, EP3, and EP4 may be determined according to a driving characteristic, a size, and the like of the display device 1000.

After the first non-emission period NEP1, in which the voltage of the fourth node N4 is initialized, a time of the first emission period EP1 for charging the capacitor Cld is sufficiently secured or obtained, and thus all of the red light emitting element, the green light emitting element, and the blue light emitting element may emit corresponding lights. Although the second emission period EP2, the third emission period EP3, and the fourth emission period EP4 are shorter than those in FIG. 3B, the pixels 10 may emit light with a desired luminance by a voltage charged in the capacitor Cld in the first emission period EP1.

Therefore, color slippage and color smudging in a driving method including the plurality of emission cycles CYC1 to CYC4 may be minimized or prevented, and image quality may be improved.

For example, the number of emission cycles CYC1 to CYC4 of FIGS. 5 and 6 is an example, and the number of emission cycles may vary according to a driving condition of the display device 1000. For example, the frame FR may include eight emission cycles or two emission cycles.

Figure 7:
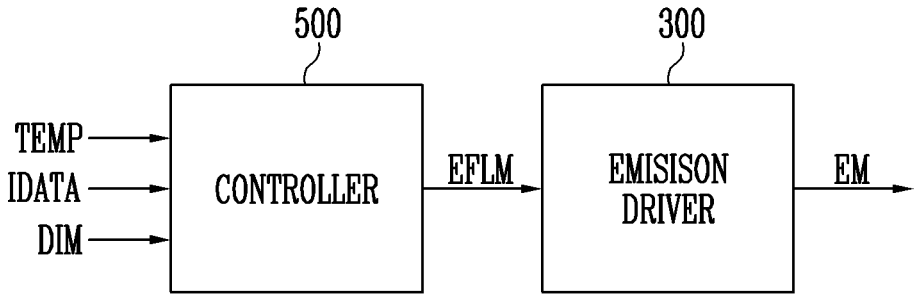
FIG. 7 is a block diagram of an example of a controller and an emission driver of the display device of FIG. 1.

FIG. 7 is a block diagram illustrating an example of the controller and the emission driver of the display device of FIG. 1.

Referring to FIGS. 2, 5, and 7, the controller 500 may generate the start signal EFLM based on a change in the input image data IDATA, a dimming level DIM determining a display luminance, and the ambient temperature TEMP. The emission driver 300 may output an emission control signal EM based on the start signal EFLM.

The controller 500 may determine whether a target frame is a moving image frame or a still image frame by analyzing the change in the input image data IDATA between frames. For example, the controller 500 may compare grayscales or a sum of grayscales of the input image data IDATA of continuous frames or subsequent frames. When the grayscale or the sum of grayscales changes, the controller 500 may determine that a corresponding frame is the moving image frame, and may be driven in a moving image mode. On the other hand, when the grayscale or the sum of grayscales of continuous preset frames is the same, the controller 500 may determine that the corresponding frame is the still image frame, and may be driven in a still image mode.

Alternatively, when a still image is displayed, the input image data IDATA may not be supplied from an external graphic source to the controller 500 after a first frame of the still image. For example, when the input image data IDATA is not supplied to the controller 500, the driving operation of the controller 500 may be driven in the still image mode.

However, this is exemplary, and a method of determining whether the corresponding frame is the moving image frame or the still image frame and/or a method of selecting one of the moving image mode and the still image mode may be determined by known various methods of analyzing the input image data IDATA.

In an embodiment, the controller 500 may determine the length of the gate-on period (e.g., the emission period) of the emission control signal EM according to the moving image frame of the moving image mode or the still image frame of the still image mode. Here, the moving image may include an image change or the like by scrolling of a screen.

In the still image in which the image does not change, image flicker may be more easily visually recognized compared to the moving image. Conversely, in the moving image in which a grayscale is changed, color slippage and color smudging may be more easily visually recognized compared to the still image. Therefore, the length of the first emission period EP1 of the moving image frame may be set to be longer than the length of the first emission period EP1 of the still image frame. In this case, the length of the second emission period EP2 of the moving image frame may be shorter than the length of the second emission period EP2 of the still image frame.

For example, in a case of the still image mode, since color slippage or color smudging is not a problem, the controller 500 may output the start signal EFLM of a waveform similar to that of the start signal of FIG. 3B. In a case of the moving image mode, the controller 500 may output the start signal EFLM of FIG. 5 to prevent color slippage or color smudging.

In an embodiment, in the moving image mode, the controller 500 may further control the length of the emission periods EP1, EP2, and EP3, and EP4 of the moving image frame based on the dimming level DIM for determining the display luminance. The controller 500 may include a lookup table in which a weight or the like for determining the length of the emission periods EP1, EP2, EP3, and EP4 corresponding to the dimming level DIM is set. Alternatively, the controller 500 may further include a lookup table, a hardware configuration, and/or an algorithm in which an equation or the like for calculating the weight according to the dimming level DIM (e.g., the display luminance) is set.

As the display luminance increases, the driving current supplied to the light emitting element may increase. The charge time for charging the capacitor Cld may decrease as the driving current increases, by a relationship between a charge amount charged in the capacitor Cld and the current.

Therefore, in order to secure or obtain the time for completely charging the capacitor Cld, the length (e.g., width) of the first emission period EP1 may further increase as the display luminance decreases. When the length of the first emission period EP1 increases, the lengths of the remaining emission periods EP2, EP3, and EP4 may decrease.

In an embodiment, in the moving image mode, the controller 500 may further control the lengths of the emission periods EP1, EP2, EP3, and EP4 of the moving image frame based on the ambient temperature TEMP of the display device. The controller 500 may further include a temperature sensor that senses the ambient temperature TEMP.

The controller 500 may include a lookup table in which the weight or the like for determining the lengths of the emission periods EP1, EP2, EP3, and EP4 corresponding to the ambient temperature TEMP is set. Alternatively, the controller may further include a lookup table, a hardware configuration, and/or an algorithm in which an equation for calculating the weight according to the ambient temperature TEMP is set.

A resistance of the light emitting element LD may increase as the ambient temperature TEMP decreases due to an element characteristic of the light emitting element LD. For example, as the ambient temperature TEMP decreases, the driving current corresponding to the same luminance and/or the same grayscale may decrease.

Therefore, in the same luminance and/or the same grayscale condition, as the ambient temperature TEMP decreases, the first emission period EP1 may be longer. When the first emission period EP1 increases, the lengths of the remaining emission periods EP2, EP3, and EP4 may decrease.

Figure 8A:
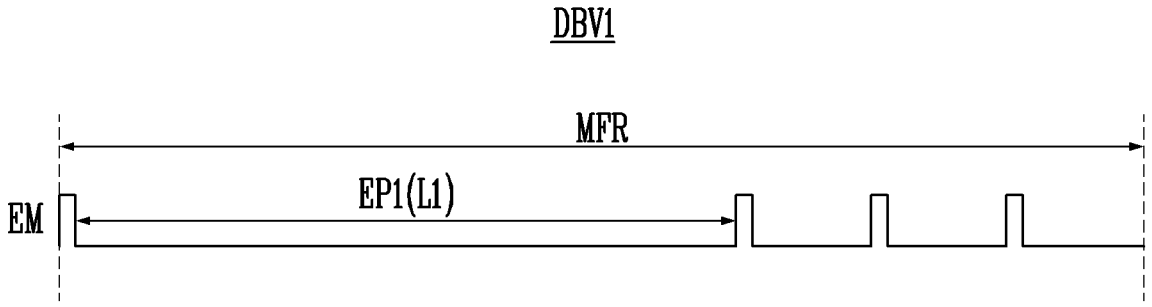
FIG. 8A, FIG. 8B, and FIG. 8C are timing diagrams illustrating examples of emission control signals output according to a display luminance.
Figure 8B:
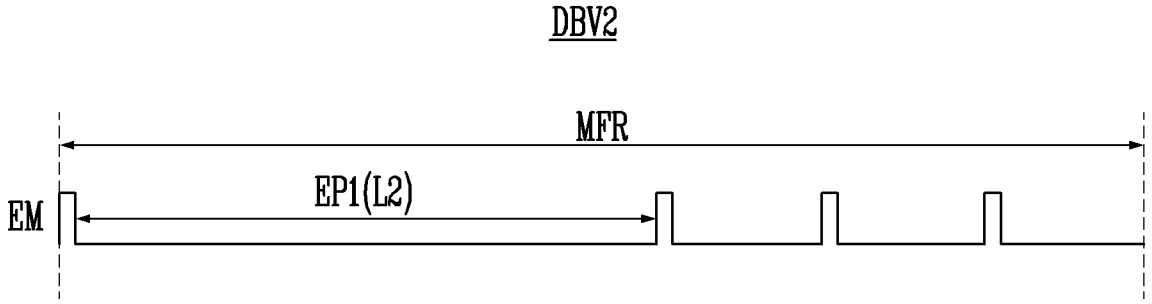
Figure 8C:
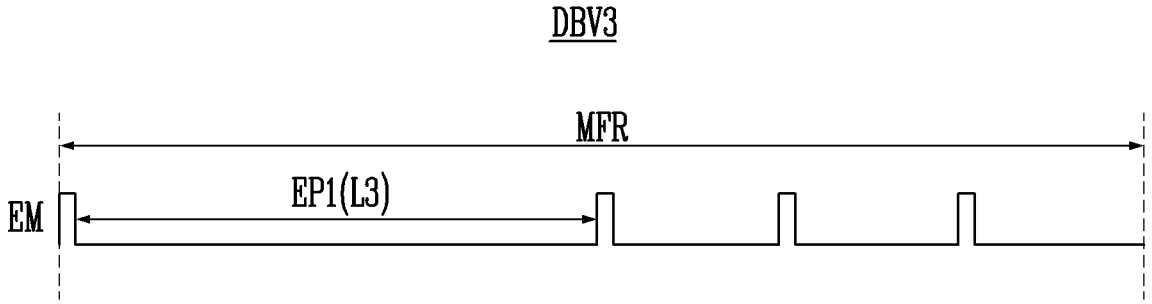

FIGS. 8A, 8B, and 8C are timing diagrams illustrating examples of the emission control signals output according to the display luminance.

Referring to FIGS. 7, 8A, 8B, and 8C, the widths of the emission periods corresponding to the gate-on period of the emission control signal EM in a moving image frame MFR may be controlled based on display luminances DBV1, DBV2, and DBV3 determined in correspondence with the dimming level.

A first display luminance DBV1 may be lower than a second display luminance DBV2, and the second display luminance DBV2 may be lower than a third display luminance DBV3. For example, the first display luminance DBV1 may be about 2 nit, the second display luminance DBV2 may be about 10 nit, and the third display luminance DBV3 may be about 30 nit. As described above, as the display luminance decreases, the length of the first emission period EP1 may increase to become longer.

Therefore, a first length L1 of the first emission period EP1 corresponding to the first display luminance DBV1 may be to be longer than a second length L2 of the first emission period EP1 corresponding to the second display luminance DBV2. In addition, the second length L2 of the first emission period EP1 may be set to be longer than a third length L3 of the first emission period EP1 corresponding to the third display luminance DBV3.

When the length (e.g., width) of the first emission period EP1 increases, the lengths (e.g., widths) of the subsequent emission periods may relatively decrease.

For example, the gate-off periods of the emission control signal EM may be set to the same length regardless of the display luminances DBV1, DBV2, and DBV3.

As described above, the display device may control the length (e.g., the width of a first gate-on period of the emission control signal EM) of the first emission period EP1 of the moving image frame MFR according to the driving current and according to the change in the display luminance in the moving image mode. Therefore, the charge time of the capacitor Cld may be sufficiently secured or obtained. Thus, color slippage and color smudging of the display device, to which impulse dimming including a plurality of emission cycles is applied, may be minimized or prevented, and image quality may be improved.

Figure 9A:
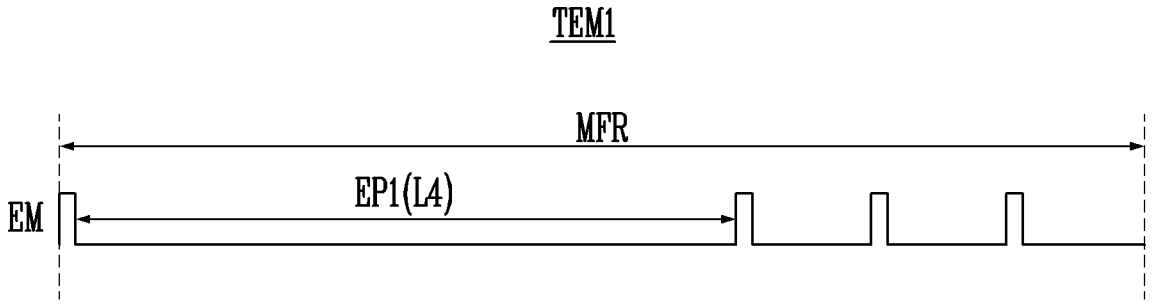
FIG. 9A, FIG. 9B, and FIG. 9C are timing diagrams illustrating examples of the emission control signals output according to an ambient temperature.
Figure 9B:
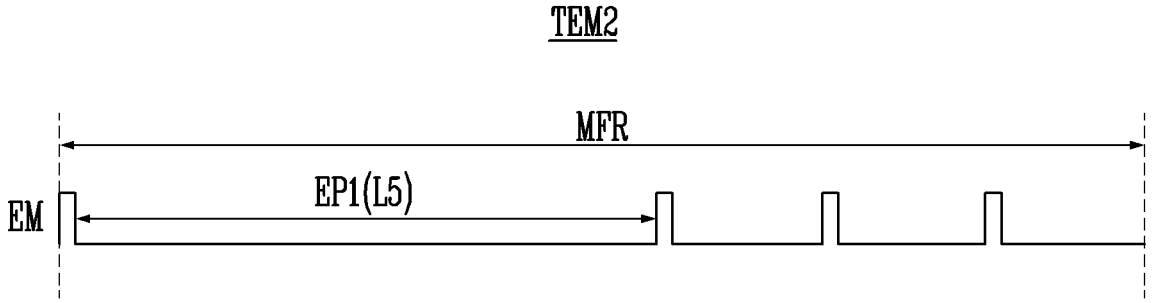
Figure 9C:
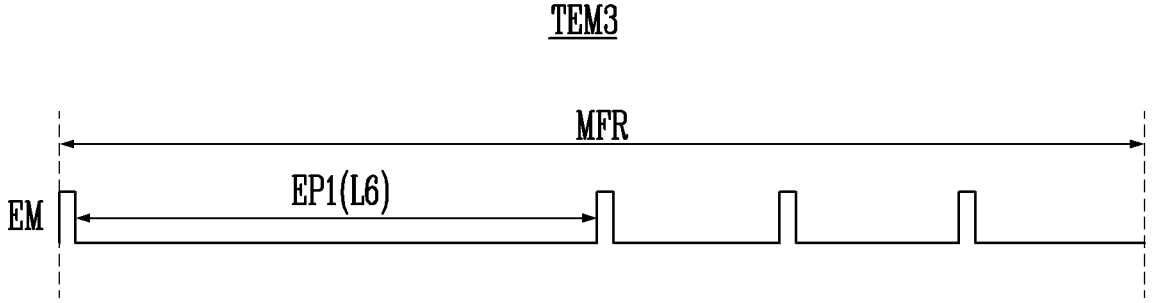

FIGS. 9A, 9B, and 9C are timing diagrams illustrating examples of the emission control signals output according to an ambient temperature.

Referring to FIGS. 7, 9A, 9B, and 9C, the lengths of the emission periods corresponding to the gate-on period of the emission control signal EM in the moving image frame MFR may be controlled based on the ambient temperature TEM.

A first temperature TEM1 may be lower than a second temperature TEM2, and the second temperature TEM2 may be lower than a third temperature TEM3. For example, the first temperature TEM1 may be about 10° C., second temperature TEM2 may be about 20° C., and the third temperature TEM3 may be about 30° C. As described above, as the ambient temperature TEMP decreases, the first emission period EP1 may increase to become longer.

Therefore, in the same display luminance condition, a fourth length L4 of the first emission period EP1 corresponding to the first temperature TEM1 may be set to be longer than a fifth length L5 of the first emission period EP1 corresponding to the second temperature TEM2. In addition, in the same display luminance condition, the fifth length L5 of the first emission period EP1 may be set to be longer than a sixth length L6 of the first emission period EP1 corresponding to the third temperature TEM3.

When the length of the first light-emitting period EP1 increases, the length of the subsequent emission periods may relatively decrease. For example, the gate-off periods of the emission control signal EM may be set to be the same regardless of the ambient temperature TEMP.

As described above, the display device controls the width (e.g., the width of the first gate-on period of the emission control signal EM) of the first emission period EP1 of the moving image frame MFR according to the change in the ambient temperature TEMP in the moving image mode. Therefore, the charge time of the capacitor Cld may be sufficiently secured or obtained. Thus, color slippage and color smudging of a display device, to which impulse dimming including a plurality of emission cycles is applied, may be minimized or prevented, and image quality may be improved.

Figure 10:
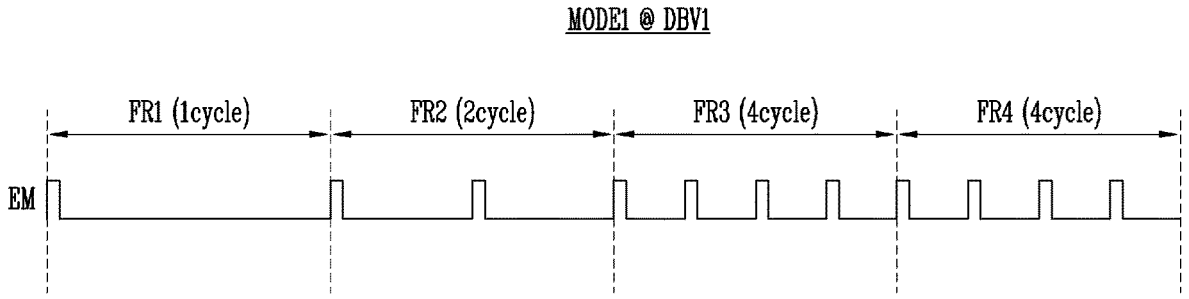
FIG. 10 is a timing diagram illustrating an example of the emission control signal output in a still image mode.
Figure 11:
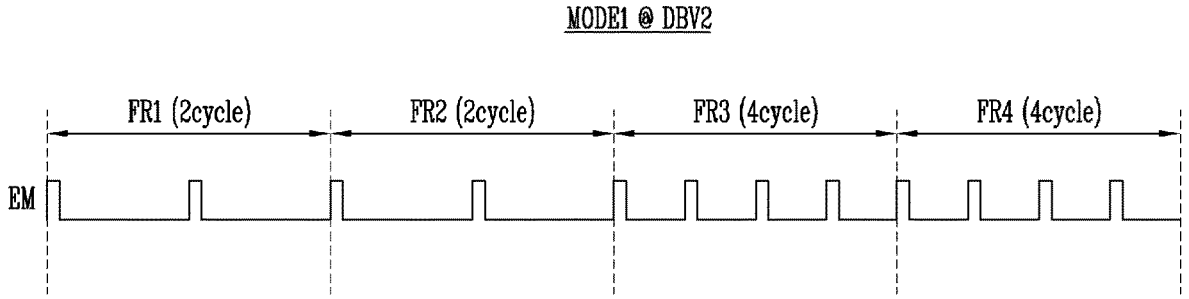
FIG. 11 is a timing diagram illustrating another example of the emission control signal output in the still image mode.

FIG. 10 is a timing diagram illustrating an example of the emission control signal output in the still image mode, and FIG. 11 is a timing diagram illustrating another example of the emission control signal output in the still image mode.

Referring to FIGS. 1, 2, 7, 10, and 11, the controller 500 may control the emission cycle of the emission control signal EM based on the change in the input image data IDATA and the display luminance.

The emission cycle may correspond to the number of discontinuous outputs of the gate-on period of the emission control signal EM during one frame. In other words, one emission cycle may include one continuous non-emission period (e.g., the gate-off period of the emission control signal) and one emission period (e.g., the gate-on period of the emission control signal) in the one frame.

FIGS. 10 and 11 show an embodiment in which the target number of the emission cycles is set to four cycles. In an embodiment, the controller 500 may gradually increase the number of emission cycles to become the target number of the emission cycles as the frame elapses. For example, as shown in FIG. 10, the number of emission cycles of a second frame FR2 may be greater than the number of emission cycles of a first frame FR1.

As described above, when the still image is displayed, image flicker has a greater influence on image quality than color smudging. Therefore, the target number of the emission cycles of a case where the still image is displayed may be two or more cycles.

However, a first frame (e.g., the first frame FR1) of the still image is a frame in which a grayscale or the like is changed from another image. Since the first frame FR1 requires a sufficient time for the capacitor Cld of the light emitting element LD to be charged, a long emission period EP is required.

Therefore, as shown in FIG. 10, the first frame FR1 of a still image mode MODE1, in which the still image is displayed, may be controlled to include one emission cycle. Thereafter, as the frame elapses, the emission cycle may gradually increase to the target number of the emission cycles.

For example, an output of the emission control signal EM may be controlled so that the number of emission cycles of the second frame FR2 is greater than the number of emission cycles of the first frame FR1.

Accordingly, color slippage or color smudging may be minimized or prevented by sufficiently securing or obtaining the charge time of the capacitor Cld in the first frame FR1 in which the image is changed. In addition, the emission cycle increases after the second frame FR2 of the still image, and thus the image flicker may be prevented or minimized, and the quality of the image may be improved.

In an embodiment, since the image changes for each frame in the moving image mode, the driving operation described with reference to FIG. 5 may be applied instead of the driving method of FIG. 10.

Since the driving operation of selecting one of the still image mode MODE1 and the moving image mode is described above with reference to FIG. 7, repetitive description thereof is omitted for descriptive convenience.

In an embodiment, in the still image mode MODE1, the controller 500 may determine the number of emission cycles for each frame based on the display luminance.

Since a speed for charging the capacitor Cld increases as the display luminance increases, color slippage or color smudging is not visually recognized even though emission time of the first frame FR1 is relatively short. For example, FIG. 10 shows a change in the emission cycle at the first display luminance DBV1, and FIG. 11 shows a change in the emission cycle at the second display luminance DBV2 higher than the first display luminance DBV1. For example, the number (see FIG. 10) of emission cycles of the first frame FR1 corresponding to the first display luminance DBV1 may be less than the number (see FIG. 11) of emission cycles of the first frame FR1 corresponding to the second display luminance DBV2.

Thereafter, the number of emission cycles in a third frame FR3 and a fourth frame FR4, in which the number of emission cycles reaches or becomes the target cycle, may be the same regardless of the display luminance.

Color slippage or color smudging may be minimized or prevented by sufficiently securing or obtaining the charge time of the capacitor Cld in the first frame FR1 in which the image is changed. In addition, after the second frame FR2 of the still image, the emission cycle increases, thereby preventing or minimizing the image flicker such that the image quality may be improved.

Furthermore, since the number of emission cycles included in an initial frames of the still image is set differently according to the display luminance, a problem of image flicker and color slippage of the image of the display device, to which impulse dimming is applied, may be simultaneously resolved such that the image quality may be improved.

Figure 12A:
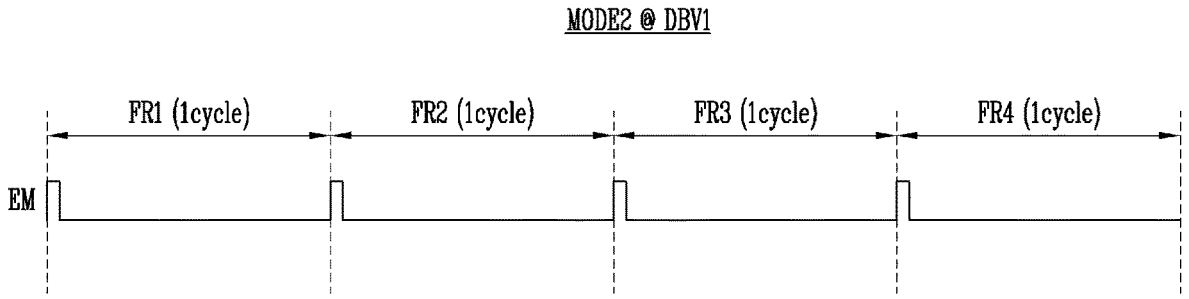
FIG. 12A and FIG. 12B are timing diagrams illustrating examples of the emission control signal output according to the display luminance in the moving image mode.
Figure 12B:
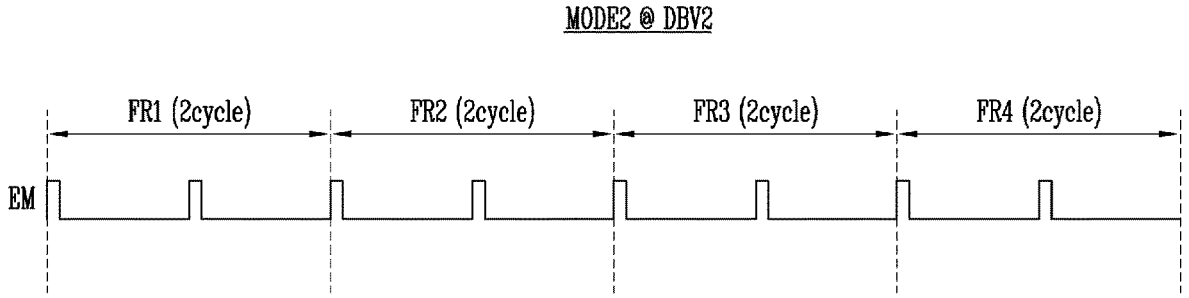

FIGS. 12A and 12B are timing diagrams illustrating examples of the emission control signal output according to the display luminance in the moving image mode.

Referring to FIGS. 7, 10, 12A, and 12B, the number of emission cycles of first frame FR1 to p-th (where, p is an integer greater than 1) frames may be the same in the moving image mode MODE2.

The controller 500 may select one of the still image mode MODE1 and the moving image mode MODE2 by analyzing the change in the input image data IDATA.

In the moving image mode MODE2, color slippage or color smudging may have a greater influence on the image quality than the image flicker. Therefore, the length of the emission period immediately after the period, in which the data signal is written, is required to be sufficiently secured or obtained. Accordingly, the target number of the emission cycles of the still image mode MODE1 may be greater than the target number of the emission cycles of the moving image mode MODE2 in the same display luminance condition. For example, as shown in FIG. 12A, a target cycle of the moving image mode MODE2 corresponding to the first display luminance DBV1 may be one cycle. Therefore, the emission control signal EM may be supplied once in each of the first to fourth frames FR1 to FR4.

For example, since the capacitor Cld is relatively quickly charged when the display luminance increases, the frame may include a plurality of emission cycles. For example, as shown in FIG. 12B, each of the first to fourth frames FR1 to FR4 may include two emission cycles in a condition of the second display luminance DBV2 of the moving image mode MODE2. For example, the emission control signal EM may be supplied twice in each of the first to fourth frames FR1 to FR4.

As described above, the display device determines whether the image is the moving image or the still image, and determines the display luminance to determine the number of emission cycles for each frame. Therefore, image quality corresponding to a change in image and a change in display luminance may be further improved.

Figure 13A:
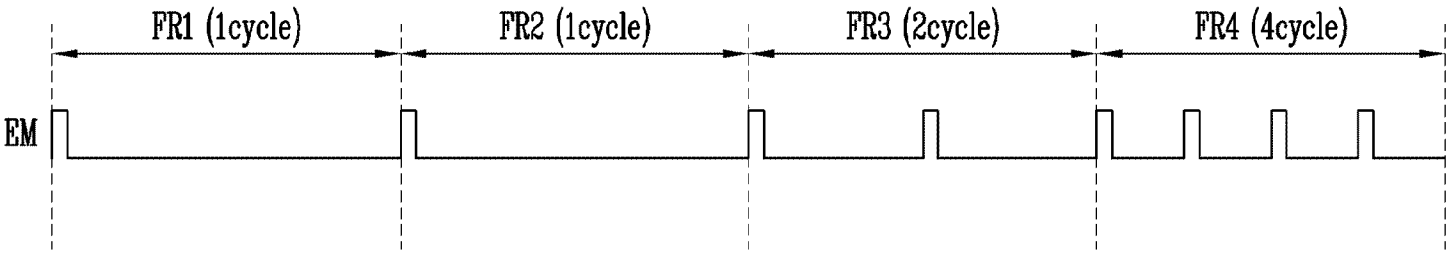
FIG. 13A and FIG. 13B are timing diagrams illustrating examples of the emission control signal output according to the ambient temperature in the still image mode.
Figure 13B:
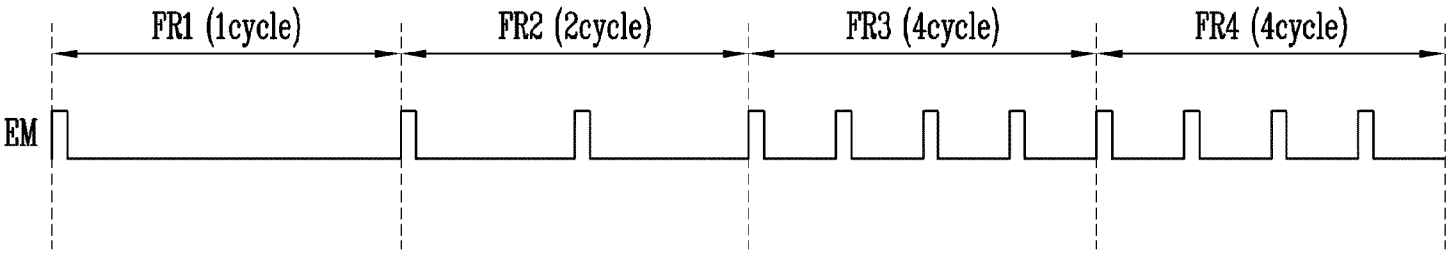

FIGS. 13A and 13B are timing diagrams illustrating examples of the emission control signal output according to the ambient temperature in the still image mode.

Referring to FIGS. 7, 13A, and 13B, the controller 500 may control a change in the emission cycle based on the ambient temperature TEMP in the still image mode MODE1.

As described above, as the ambient temperature TEMP decreases, the driving current corresponding to the same luminance and/or the same grayscale may decrease. Therefore, a sufficient emission period is required to be secured or obtained at a relatively low ambient temperature TEMP.

FIG. 13A shows an output of the emission control signal EM at the first temperature TEM1, and FIG. 13B shows the output of the emission control signal EM at the second temperature TEM2. The first temperature TEM1 may be lower than the second temperature TEM2.

In an embodiment, in the same display luminance condition, the number of frames required for increasing the number of emission cycles to the target number of the emission cycles corresponding to the first temperature TEM1 may be greater than the number of frames required for increasing the number of emission cycles to the target number of the emission cycles corresponding to the second temperature TEM2. For example, as shown in FIGS. 13A and 13B, the emission control signal EM may be supplied in the fourth frame FR4 four times in correspondence with the target number at the first temperature TEM1, and the emission control signal EM may be supplied in the third frame FR3 four times at the second temperature TEM2.

Therefore, the display device may further improve image quality by adaptively controlling the emission cycle of initial frames of the still image in correspondence with a temperature change.

As described above, the display device according to embodiments of the disclosure may control the length of emission periods of the impulse dimming driving operation and/or the number of emission cycles based on the change in the image data, the display luminance, and the ambient temperature. Accordingly, image flicker and color slippage or color smudging of both the moving image and the still image may be minimized or prevented such that the image quality may be improved.

Although the disclosure has been described with reference to the embodiments thereof, it will be understood by those skilled in the art that various changes and modifications of the disclosure may be made without departing from the spirit and scope of the disclosure disclosed in the following claims.

What is claimed is:

1. A display device comprising:

a pixel;

a scan driver configured to supply a scan signal to the pixel through a scan line;

an emission driver configured to supply an emission control signal comprising a plurality of gate-on level signals to the pixel through an emission control line in one frame, the plurality of gate-on level signals for generating emission periods of the pixel;

a data driver configured to supply a data signal to the pixel through a data line; and a controller configured to control a waveform of the emission control signal, wherein a length of a first emission period of the emission periods is longer than a length of a subsequent emission period of the emission periods, wherein the controller is configured to analyze a change in image data to select one of a moving image mode and a still image mode and configured to adjust lengths of the emission periods according to a moving image frame of the moving image mode or a still image frame of the still image mode.

2. The display device of claim 1, wherein:

non-emission periods of the pixel are generated by a plurality of gate-off level signals of the emission control signal, and lengths of the non-emission periods are the same in the one frame.

3. The display device of claim 2, wherein lengths of the emission periods correspond to widths of the plurality of gate-on level signals of the emission control signal, respectively.

4. The display device of claim 1, wherein lengths of remaining emission periods of the emission periods except for the first emission period are the same.

5. The display device of claim 1, wherein a length of a second emission period of the emission periods in the one frame is longer than a length of a third emission period of the emission periods.

6. The display device of claim 1, wherein the length of the first emission period of the moving image frame is longer than the length of the first emission period of the still image frame, and a length of a second emission period of the moving image frame is shorter than the length of the second emission period of the still image frame.

7. The display device of claim 1, wherein in the moving image mode, the controller is configured to control the lengths of the emission periods of the moving image frame based on a display luminance.

8. The display device of claim 7, wherein the length of the first emission period corresponding to a first display luminance is longer than the length of the first emission period corresponding to a second display luminance greater than the first display luminance.

9. The display device of claim 1, wherein in the moving image mode, the controller is configured to control the lengths of the emission periods of the moving image frame based on an ambient temperature of the display device.

10. The display device of claim 9, wherein in a same display luminance condition, the length of the first emission period corresponding to a first temperature is longer than the length of the first emission period corresponding to a second temperature greater than the first temperature.

11. A display device comprising:

a pixel;

a scan driver configured to supply a scan signal to the pixel through a scan line;

an emission driver configured to supply an emission control signal comprising a plurality of gate-on level signals to the pixel through an emission control line, the plurality of gate-on level signals for generating emission cycles of the pixel;

a data driver configured to supply a data signal to the pixel through a data line; and a controller configured to control a number of the emission cycles during one frame based on an image data change and a display luminance, wherein the controller is configured to gradually increase the number of the emission cycles to a target number of the emission cycles as a plurality of frames elapse, and wherein the number of the emission cycles of a second frame of the plurality of frames is greater than the number of the emission cycles of a first frame of the plurality of frames.

12. The display device of claim 11, wherein the number of the emission cycles of a first frame corresponding to a first display luminance is less than the number of the emission cycles of the first frame corresponding to a second display luminance greater than the first display luminance, and the number of the emission cycles of a k-th frame corresponding to the first display luminance is the same as the number of the emission cycles of the k-th frame corresponding to the second display luminance, where k is an integer greater than 3.

13. The display device of claim 12, wherein the controller is configured to analyze the image data change to select one of a still image mode and a moving image mode, when the still image mode is started, the controller is configured to gradually increase the number of the emission cycles to a target number of the emission cycles as a plurality of frames elapse, and the number of the emission cycles of the k-th frame of the still image mode is greater than the number of the emission cycles of the k-th frame of the moving image mode.

14. The display device of claim 12, wherein the controller is configured to further control a change in the emission cycles based on an ambient temperature of the display device, and in a same display luminance condition, a number of a plurality of frames required for increasing the number of the emission cycles to a target number of the emission cycles in correspondence with a first temperature is greater than the number of the plurality of frames required for increasing the number of the emission cycles to the target number of the emission cycles in correspondence with a second temperature greater than the first temperature.

15. A display device comprising:

a pixel;

a scan driver configured to supply a scan signal to the pixel through a scan line;

an emission driver configured to supply an emission control signal comprising a plurality of gate-on level signals to the pixel through an emission control line, the plurality of gate-on level signals for generating emission periods and emission cycles of the pixel;

a data driver configured to supply a data signal to the pixel through a data line; and a controller configured to control lengths of the emission periods and a number of the emission cycles during one frame, based on a change of image data and a display luminance, wherein the number of the emission cycles gradually increases to become a target number of the emission cycles as a plurality of frames elapse in a still image mode, wherein the number of the emission cycles gradually increases to become a target number of the emission cycles as a plurality of frames elapse in a still image mode, in the still image mode, the number of the emission cycles of a first frame of the plurality of frames corresponding to a first display luminance is less than the number of the emission cycles of the first frame corresponding to a second display luminance greater than the first display luminance, and a number of the emission cycles of a k-th frame corresponding to the first display luminance is the same as the number of the emission cycles of the k-th frame corresponding to the second display luminance, where k is an integer greater than 3.

16. The display device of claim 15, wherein in a moving image frame of a moving image mode, a length of a first emission period of the emission periods is longer than a length of another emission period of the emission periods, and wherein, in the moving image mode, the length of the first emission period corresponding to a first display luminance is longer than the length of the first emission period corresponding to a second display luminance greater than the first display luminance.

* * * * *